US006557500B1

(12) United States Patent
Schroeder

(10) Patent No.: US 6,557,500 B1
(45) Date of Patent: May 6, 2003

(54) EVAPORATOR AND EVAPORATIVE PROCESS FOR GENERATING SATURATED STEAM

(75) Inventor: Joseph E. Schroeder, Franklin County, MO (US)

(73) Assignee: Nooter/Eriksen, Inc., Fenton, MO (US)

( * ) Notice: Subject to any disclaimer, the term of this patent is extended or adjusted under 35 U.S.C. 154(b) by 0 days.

(21) Appl. No.: 10/183,244

(22) Filed: Jun. 27, 2002

Related U.S. Application Data

(60) Provisional application No. 60/337,370, filed on Dec. 5, 2001.

(51) Int. Cl.[7] ..... F22D 1/00

(52) U.S. Cl. ..... 122/7 R; 122/406.1; 122/451 S

(58) Field of Search ..... 122/1 B, 1 C, 122/7 R, 451 S, 406.1

(56) References Cited

U.S. PATENT DOCUMENTS

| | | | | |
|---|---|---|---|---|
| 4,799,461 A | * | 1/1989 | Shigenaka et al. | 122/7 R |
| 5,419,285 A | * | 5/1995 | Gurevich et al. | 122/406.1 |
| 6,092,490 A | | 7/2000 | Bairley et al. | |
| 6,189,491 B1 | | 2/2001 | Wittchow et al. | |

* cited by examiner

*Primary Examiner*—Jiping Lu
(74) *Attorney, Agent, or Firm*—Polster, Lieder, Woodruff & Lucchesi, L.C.

(57) ABSTRACT

An evaporator in a steam generator extracts heat from high temperature gases to convert heated water into saturated steam. The evaporator includes two sections—a once-through section and a circulation section, both of which include tubes located in the flow of hot gases. Heated water flows through the tubes of the once-through section at a rate sufficient to maintain the interiors of its tube fully wetted while enabling steam to develop in that water, with the steam having a quality of at least 20%. The circulation section includes a drum that is connected to the tubes of that section such that water from the drum circulates through the tubes and then back to the drum, with the circulation being such that the water in the tubes of the circulation section keeps the tubes fully wetted while steam develops in that water. The water from the tubes of the once-through section discharges into the drum as does the water circulating back from the tubes of the circulation section. Within the drum, the steam formerly entrained in the water escapes. Since the tubes of both sections remain fully wetted the heat transfer occurs most efficiently. The presence of the once-through section enables the circulation section to be reduced in size and this shortens start up. The drum confines most impurities to the liquid water that is circulated in the circulation section, and these impurities may be removed through a blowdown.

18 Claims, 1 Drawing Sheet

EVAPORATOR AND EVAPORATIVE PROCESS FOR GENERATING SATURATED STEAM

CROSS REFERENCE TO RELATED APPLICATIONS

This application derives priority from U.S. Provisional Application Serial No. 60/337,370 filed Dec. 5, 2001.

STATEMENT REGARDING FEDERALLY SPONSORED RESEARCH OR DEVELOPMENT

Not applicable

BACKGROUND OF THE INVENTION

This invention relates in general to steam generators and more particularly to evaporator for a steam generator and to an evaporation process.

Much of the equipment for generating electrical power relies on steam, and so do a variety of industrial processes. In either case, hot gases, in many instances generated by combustion, pass through a generator which converts water into superheated steam. Typical of these installations are heat recovery steam generators (HRSGs) which are used to extract heat from the hot gases discharged by gas turbines that drive electrical generators. The heat extracted produces steam which passes on to a steam turbine that powers another electrical generator.

The typical steam generator, aside from a duct through which the hot gases pass, in its most basic form, includes three additional components—namely, a superheater, an evaporator, and an economizer or feedwater heater arranged in that order with respect to the flow of gases in the duct. The water flows in the opposite direction, that is through the economizer where it is heated, but remains a liquid, then through the evaporator where it is converted into saturated steam, and then through the superheater where the saturated steam becomes superheated steam.

Evaporators come in two basic configurations—the circulation type and the once-through type—each with its own advantages and disadvantages. Both have an array of tubes in the duct through which the hot gases pass.

In the circulation type, the tubes reside in a circuit with a steam drum that is above the tubes. The drum contains water which flows from the drum, through a downcomer, and then into the tubes where some of it is converted into steam, but the steam exists as bubbles within the water, and is returned through a riser into the steam drum. Here the steam, which is saturated, separates from the liquid water and passes onto the superheater. It is replaced by feedwater which is supplied to the drum. The tubes of a circulation evaporator remain wet all the time—that is to say, liquid water exists against their interior surfaces throughout—and this promotes good heat transfer. Moreover, impurities, such as dissolved salts, concentrate in the water within the drum and the remainder of the circulation loop, leaving the saturated steam that escapes largely free of them. A small water flow, known as blowdown, is extracted from the drum to control the accumulation of impurities. Most circulation evaporators rely entirely on the variance in density between the water in the downcomer and the water-steam mixture in the tubes to circulate the water in the evaporator, although some have a pump assist. Furthermore, a circulation evaporator contains a reservoir of stored water. Thus, the failure of a pump does not immediately affect the operation of the evaporator and render it vulnerable to overheating. Also, circulation evaporators operate very well over a wide range of load conditions. Finally, circulation evaporators predominate, and as a consequence boiler operators are familiar with their operation.

But circulation evaporators have their detractions. Perhaps the greatest of these is the expense attributable to steam drums, large downcomers and headers to supply water to their tubes. Moreover, the reservoirs of water contained in them require time to bring up the boiling temperature, so the start-up time for a circulation evaporator is extended.

Once-through evaporators do not require downcomers or drums, so the only stored water in them resides in the tubes themselves. This enables a once-through evaporator to be brought to operating conditions more rapidly than a natural circulation evaporator. However, a once-through evaporator must completely convert the water into steam, so that only saturated steam escapes and flows on to the superheater. No liquid water should leave the evaporator. As a consequence, regions of the tubes run dry, that is to say, their interiors are not wetted by liquid water. The transfer of heat diminishes significantly in these regions, even though the regions operate at temperatures in excess of the wetted regions. Some manufactures of once-through evaporators resort to high alloy metals to enable the tubes to better withstand the elevated temperatures. Whereas, a circulation evaporator discharges steam that is largely free of impurities, a once-through evaporator will discharge steam containing all the impurities present in the feedwater that is pumped into it. Therefore, the feedwater needs to be treated to eliminate as many impurities as possible.

Thus, circulation and once-though evaporators each have advantages and disadvantages.

SUMMARY OF THE INVENTION

The present invention resides in an evaporator that possesses many of the advantages of both a circulation evaporator and a once-through evaporator, but few of the disadvantages. To this end, it includes first tubes located in a flow of hot gasses, second tubes also located in the flow, and a vessel connected to both the first and second tubes such that it receives water from the first tubes and such that water from in the vessel circulates through the second tubes and back to the vessel. The invention also resides in the process embodied in the operation of the evaporator.

DETAILED DESCRIPTION OF INVENTION

Figure 1:
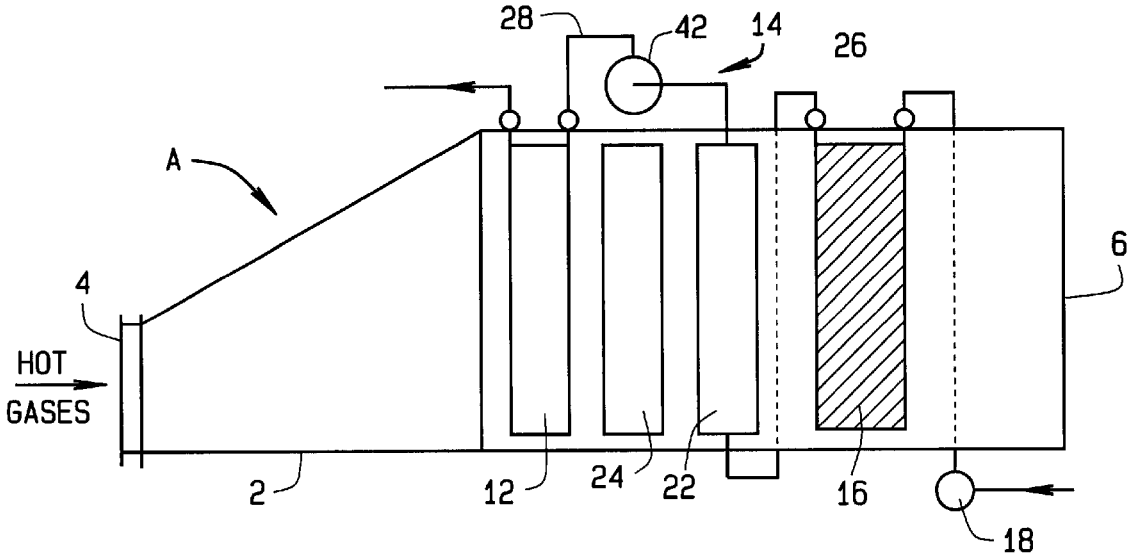
FIG. 1 is a schematic sectional view of a steam generator equipped with an evaporator constructed in accordance with and embodying the present invention.

Referring now to the drawings, a steam generator A (FIG. 1) basically includes a duct 2 having an inlet end 4 and a discharge end 6. The inlet end 4 is connected to a source of hot gases, such as a gas turbine or an incinerator, and those gases flow through the duct 2, leaving at the discharged end 6. In addition, the steam generator A includes a superheater 12, an evaporator 14, and a feedwater heater or economizer 16 arranged in the duct 2 in that order from the inlet end 4 to the outlet end 6. Thus, the hot gases flow first through the superheater 12, then through the evaporator 14, and finally through the economizer 16. Water flows in the opposite direction. More specifically, the economizer 16 is connected to a feedwater pump 18 which delivers feedwater as a liquid to the economizer 16. It extracts heat from the hot gases and transfers that heat to the liquid water that flows through it, thereby elevating the temperature of the water. Leaving the economizer 16, the liquid water then flows to the evaporator 14 through which it passes. The evaporator 14 elevates the temperature of the liquid water still higher—indeed, high enough to convert some of it to saturated steam. The saturated steam flows into the superheater 12 which raises its temperature, transforming it into superheated steam which may be used to power a turbine or in some industrial process or even to heat a building. The superheater 12 and economizer 16 are basically tube banks. The evaporator 14 is more complex.

Figure 2:
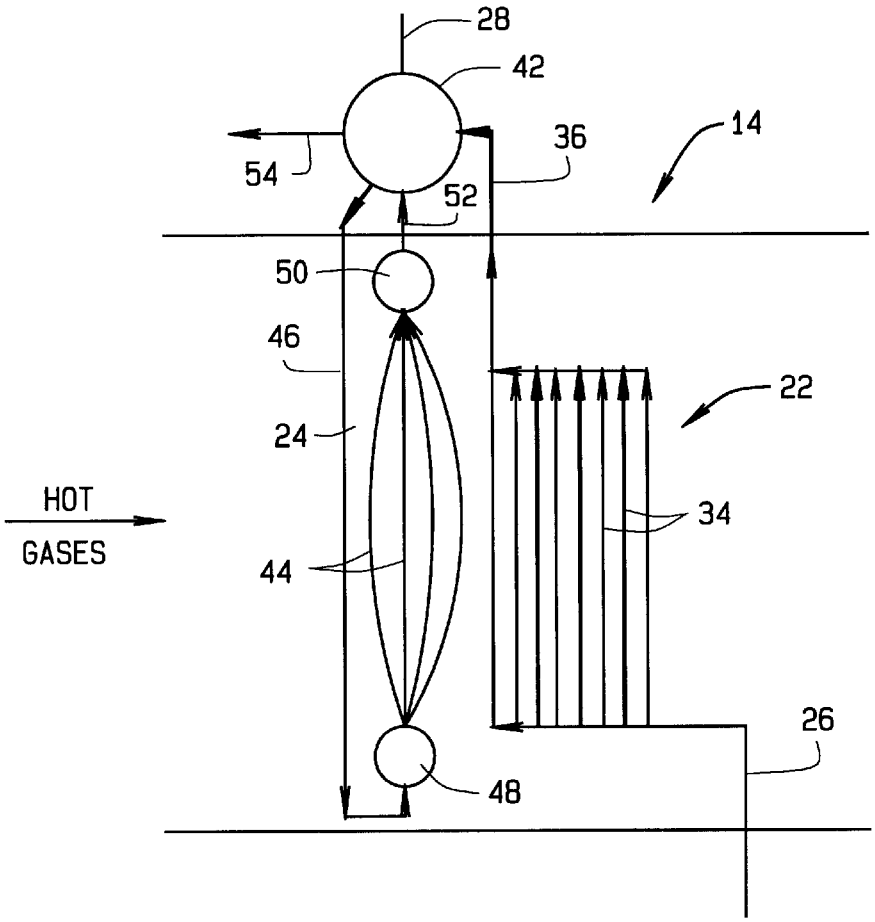
FIG. 2 is a schematic view of the evaporator.

The evaporator 14, to a measure, represents a combination of a once-though evaporator and a natural circulation evaporator. As such it includes (FIG. 2) a once-through section 22 and a natural circulation section 24. Heated water from the economizer 16, which water is in the liquid phase, is introduced into the once-through section 22 at a feed line 26 and in the two sections 22 and 24 is transformed into saturated steam which is discharged from the natural circulation section 24 into a discharge line 28 which delivers it to the superheater 12.

Considering the once-through section 22 first, it includes (FIG. 2) tubes 34 that lie within the duct 2, so that the hot gases pass over them. It also includes a connecting line 36 that leads to the natural circulation section 24. The economizer 16 delivers warm water to the tubes 34 of the once-through section 22 where some of the water is converted into saturated steam in the tubes 34. The flow is such that the outlet quality of the steam remains low and the interiors of the tubes 34 remain wetted in their entireties, and this flow is controlled by the feedwater pump 18. Thus, liquid water, even though it may contain bubbles of saturated steam, exists in the interiors of the tubes 34. In contrast to a conventional once-though evaporator, the tubes 34 of the once-through section 22 possess no dry walls. Indeed, the arrangement is such as to insure that the tubes 34 remain wetted throughout, and also to insure that the quality of the steam in the connecting line 36 ranges between 20% and 90% and preferably between 40% and 60%. "Quality" means the fraction by weight of the mixture of water and steam that is actually steam. Thus, a flow with 40% quality steam contains 40% steam by weight and 60% liquid water by weight.

The natural circulation section 24 includes (FIG. 2) a steam drum 42, which is a vessel located outside and above the duct 2, and tubes 44 which are located in the duct 2. In addition, the natural circulation section 24 has a downcomer 46 which leads downwardly from the drum 42, outside of the duct 2, and at its lower end opens into a distribution header 48 that extends through the duct 2 where the lower ends of the tubes 44 are connected to it. Also, the natural circulation section 24 has a collection header 48 into which the upper ends of the tubes 44 open within the duct 2 and risers 52 which lead from the collection header 50 to the drum 42. Finally, the drum 42 has a blowdown line 54 connected to it.

The steam drum 42, the downcomer 46, the two headers 48 and 50, as well as the tubes 44 between them and the risers 52, all contain liquid water, and that water comes from the once-through section 22. To this end, the connecting line 36 from the tubes 34 of the once-through section 22 opens into the drum 42. The once-through section 22 delivers enough liquid water to the drum 42 to maintain the drum 42 partially filled with liquid water all the time. The connecting line 36 opens into the drum 42, below the water level in the drum 42 as do the risers 52. The downcomer 46 and the blowdown line 54 lead from the drum 42 below the water level in the drum 42.

The tubes 34 and 44 of the two sections 22 and 24, respectively, may be organized side-by-side in the duct 2, or with the tubes 34 ahead of the tubes 44, or with the tubes 44 ahead of the tubes 34. The last is preferred.

In the operation of the steam generator A, the feedwater pump 18 delivers relatively cool feedwater to the economizer 16, through which it passes, and is heated as it does. The heated feedwater flows into the once-through section 22 of the evaporator 14 where at least 20% of it and preferably 50% is converted to saturated steam and the rest remains as water which is circulated through the natural circulation section 24 to become more saturated steam. The steam produced in the two sections 22 and 24 leaves the evaporator 14 through the discharge line 28 which directs it into the superheater 12. Within the superheater 12 the saturated steam from the evaporator 14 becomes superheated steam.

Considering the operation of the evaporator 14 more fully, the feedwater pump 18 forces water into the tubes 34 of its once-through section 22, and the tubes 34, being heated by the hot gases in the duct 2, transfer heat to the water. The tubes 34 operate at a temperature somewhat above the boiling point of the water, so some of the water in the tubes 34 transforms into saturated steam—but not all. Indeed, the flow through the tubes 34 remains great enough to produce a steam quality between 20% and 90% preferably between 40% and 60%. Since the quality is below 100% the interiors of the tubes 34 remain fully wetted. The steam that is produced in the tubes 34 takes the form of bubbles entrained in the liquid water. That water flows out of the tubes 34 and into the connecting line 36 which directs it into the steam drum 42 of the natural circulation section 24.

The natural circulation section 24 itself is filled with liquid water, indeed to a level which partially fills the drum 42 that forms the highest part of the evaporator 14. The connecting line 36 discharges the water—and steam—from the once-through section 22 into the steam drum 42 below the level of the liquid water in the drum 42. Upon entering the drum 42, the entrained steam escapes into the upper portion of the drum 42 and from there flows out of the drum 42 into the discharge line 28. The liquid water from the once-through section 22 mixes with the water in the drum 42. It represents the sole supply of liquid water for the drum 42 and the entire natural circulation section 24. Impurities in the water that enters drum 42 from the once-through section 22 remain in the water in the drum 42. As in a conventional natural circulation system, few of the impurities stay with the steam that escapes.

The water that is delivered to the drum 42 of the natural circulation section 24 represents the source of water for that section 24. The liquid water that collects in the drum 42 flows out of the drum 42 into the downcomer 46 and then into the distribution header 48 where it is distributed to the tubes 44 in the section 24. The hot gases in the duct 2 flow across the tubes 44, heating them, and accordingly, the tubes 44 transfer heat possessed by the gases to the water in the tubes 44. Some of the water boils, but not all of it, so the interiors of the tubes 44 likewise remain wetted in their entireties, thus, assuring efficient transfer of heat from the gases to the water. The steam which develops as a consequence of the boiling exists as bubbles in the water that leaves the tubes 44. That water, with the steam entrained in it, flows out of the tubes 44 into the header 50 and thence into the risers 52 which direct it back into the steam drum 42. The steam escapes into the upper portion of the drum 42 and from there leaves through the discharge line 28 in a saturated condition. Actually, the water from the once-through section 22 and the water delivered from the risers 52 of circulation section mix in the drum 42. The water from both sections 22 and 24 has saturated steam entrained in it, and that steam escapes into the upper portion of the drum 42 and flows on to the superheater 12 through the discharge line 28. Thus, the water that flows downwardly through the downcomer 46 represents water from two sources—namely, from the tubes 34 of the once-through section 22 and from the tubes 44 of the circulation section 24.

From time to time liquid water is bled from the drum 42 through the blowdown line 54, and this limits the accumulation of impurities in the water that circulates through the natural circulation section 24.

Since much of the saturated steam that is produced by the evaporator 14 derives from the once through section 22, the natural circulation section 24 may be considerably smaller than a single conventional natural circulation evaporator of capacity equivalent to the overall evaporator 14. The smaller size translates into a smaller downcomer 46 and smaller headers 48 and 50, and fewer tubes 44 as well. It also enables the circulation section 24 to reach operating conditions in less time, thereby minimizing startup. Even so, the evaporator 14 has stored water which gives a measure of protection against running dry. Dry wall conditions do not exist in the evaporator 14, so the evaporator 14 does not suffer the heat transfer penalties associated with such conditions. The circulation section 24 inherently avoids dry walls in its tubes 44, whereas the excess water pumped through the tubes 34 of the once-through section 22 avoids dry wall conditions in that section 22. No special efforts are required to remove impurities from the water entering the evaporator 14 at its feed line 26, since the drum 42 inherently removes impurities and prevents them from flowing out of the evaporator 14 and into the discharge line 28.

In lieu of relying entirely on variances in density to circulate water through the section 24, a pump may be utilized. Thus, the expression "circulation section" means an evaporator section that relies on natural circulation or pump-assisted circulation. Also, the steam produced in the tubes 34 of the once-through section 22 may be separated from the liquid water before the steam drum 42, but the liquid water from the section 22 should flow on to the steam drum 42.

In some conventional steam generators which utilize natural circulation evaporators, the economizers have been known to overheat and produce saturated steam. But the quality of steam produced by these steaming economizers does not approach the quality of steam produced by the once-through section 22 of the evaporator 14, so the evaporator 14 differs in that major respect from a natural circulation evaporator coupled to a steaming economizer.

What is claimed is:

1. An evaporator for extracting heat from a stream of hot gases to convert liquid water into saturated steam, said evaporator comprising:

first tubes located in the stream and connected to a source of liquid water, such that the liquid water is circulated through the first tubes at a flow rate which enables the first tubes to convert the water into a mixture of water and steam, with the quality of the steam being at least about 20% a vessel in communication with the first tubes for receiving the liquid water from the first tubes;

second tubes located in the stream of hot gases and being connected to the vessel such that water from the vessel will circulate into the second tubes and then back into the vessel; and a discharge on the vessel for enabling saturated steam to escape from the vessel.

2. An evaporator according to claim 1 and further comprising a downcomer connecting the vessel with the second tubes.

3. An evaporator according to claim 2 wherein the second tubes have upper and lower ends; and wherein the downcomer is connected to the lower ends and the upper ends are connected with the vessel.

4. An evaporator according to claim 3 and further comprising a blowdown connected to the vessel for extracting water from the vessel to reduce the concentration of impurities in the vessel, downcomer, and second tubes.

5. An evaporator according to claim 3 and further comprising a riser located between the upper ends of the tubes and the vessel.

6. An evaporator according to claim 1 wherein the vessel receives the mixture of water and steam discharged from the first tubes and the mixture contains steam at a quality of at least 40%.

7. In combination with a duct though which hot gases flow and an economizer located in the duct for elevating the temperature of liquid water, an evaporator for converting liquid water from the economizer into steam, said evaporator comprising:

first tubes located in the duct;

second tubes located in the duct;

a pump for forcing liquid water through the first tubes at a rate sufficient to enable the water to wet the interiors of the first tubes in their entireties, while steam develops in that water, whereby liquid water with steam entrained in it is discharged from the first tubes; and a drum connected with the first tubes such that it receives from the first tubes the liquid water, the drum also being connected with the second tubes such that water from the drum circulates through the second tubes and back to the drum, with the water developing steam in the second tubes while the interiors of the second tubes remain wetted by the water in their entireties.

8. The combination according to claim 7 wherein the mixture of water and steam discharged from the first tubes is between 20% and 90% steam by weight.

9. The combination according to claim 8 and further comprising a blowdown connected to the drum for extracting water from the drum to reduce impurities in the water that is circulated through the second tubes.

10. The combination according to claim 8 wherein the second tubes are located in the duct upstream from the first tubes.

11. The combination according to claim 8 and further comprising a superheater located in the duct upstream from the evaporator and being connected to the evaporator for receiving saturated steam from the evaporator.

12. The combination according to claim 11 wherein the economizer is located in the duct downstream from the evaporator.

13. A process for producing saturated steam from a flow of hot gases, said process comprising:

introducing liquid water into first tubes that are located in the flow of the gases, forcing the liquid water through the tubes at rate sufficient to enable the interiors of the tubes to be fully wetted by the water while steam develops within the water, with the steam having a quality of at least 20%, whereby the water upon leaving the first tubes has steam entrained in it;

separating the entrained steam from the liquid water leaving the first tubes;

introducing the liquid water from the first tubes into a vessel;

circulating the liquid water from the vessel through second tubes that are located in the flow of gases, and then back into the vessel, with the circulation being such that the interiors of second tubes remain wetted in their entireties by the water, yet steam develops in the water so that the water entering the vessel from the second tubes has steam entrained in it; and in the vessel separating the entrained steam from the water leaving the second tubes.

14. The process according to claim 13 wherein the steam entrained in the liquid water from the first tubes is separated from the liquid water in the vessel.

15. The process according to claim 13 wherein the mixture of water and steam discharged from the first tubes is between about 20% and about 90% steam by weight.

16. The process according to claim 13 wherein the mixture of water and steam discharged from the first tubes is between about 40% and about 60% steam by weight.

17. The process according to claim 13 wherein the vessel is located above the second tubes.

18. The process according to claim 13 and further comprising: extracting liquid water from the vessel to improve the purity of the water that circulates through the vessel and second tubes.

* * * * *